US005249112A

United States Patent [19]

Bray

[11] Patent Number: 5,249,112

[45] Date of Patent: Sep. 28, 1993

[54] CONFIGURABLE LIGHTING SYSTEM

[75] Inventor: Douglas R. Bray, Medford, N.J.

[73] Assignee: Sea Gull Lighting, Riverside, N.J.

[21] Appl. No.: 824,821

[22] Filed: Jan. 22, 1992

[51] Int. Cl.[5] ..... F21V 21/02

[52] U.S. Cl. ..... 362/306; 362/388; 362/431; 362/432

[58] Field of Search ..... 362/306, 285, 288, 363, 362/388, 431, 457, 458, 801, 351, 432

[56] References Cited

U.S. PATENT DOCUMENTS

| | | | |
|---|---|---|---|
| 4,104,711 | 8/1978 | Carter | 362/363 |
| 4,232,362 | 11/1980 | Williams et al. | 362/801 |
| 4,388,674 | 6/1983 | Sano | 362/363 |
| 4,639,843 | 1/1987 | Compton | 362/431 |
| 4,794,502 | 12/1988 | Guggemos | 362/363 |
| 4,827,389 | 5/1989 | Crum | 362/388 |
| 4,878,159 | 10/1989 | Blaisdell et al. | 362/363 |
| 4,969,074 | 11/1990 | Davis et al. | 362/363 |
| 5,084,809 | 1/1992 | Bogdanovs | 362/388 |

FOREIGN PATENT DOCUMENTS

| | | | |
|---|---|---|---|
| 426238 | 5/1991 | European Pat. Off. | 362/431 |

*Primary Examiner*—Richard R. Cole

*Attorney, Agent, or Firm*—Seidel, Gonda, Lavorgna & Monaco

[57] ABSTRACT

A selectably-configurable lighting fixture comprising a body having a coupling thereon for selectably and releasably receiving at least one of a plurality of interchangeable components. The components include at least a shade and a mounting member for mounting the fixture to a support. The fixture also comprises a lamp support for supporting a lamp on the body in operative relation to the shade for illuminating a space adjacent the fixture.

21 Claims, 6 Drawing Sheets

FIG.1
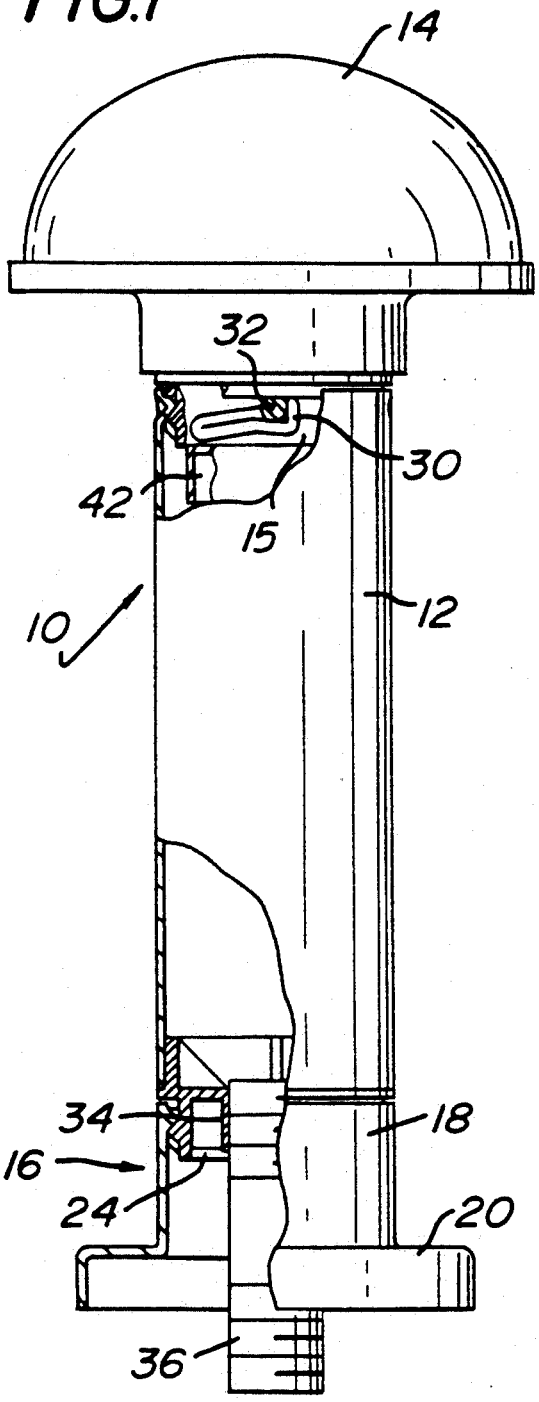
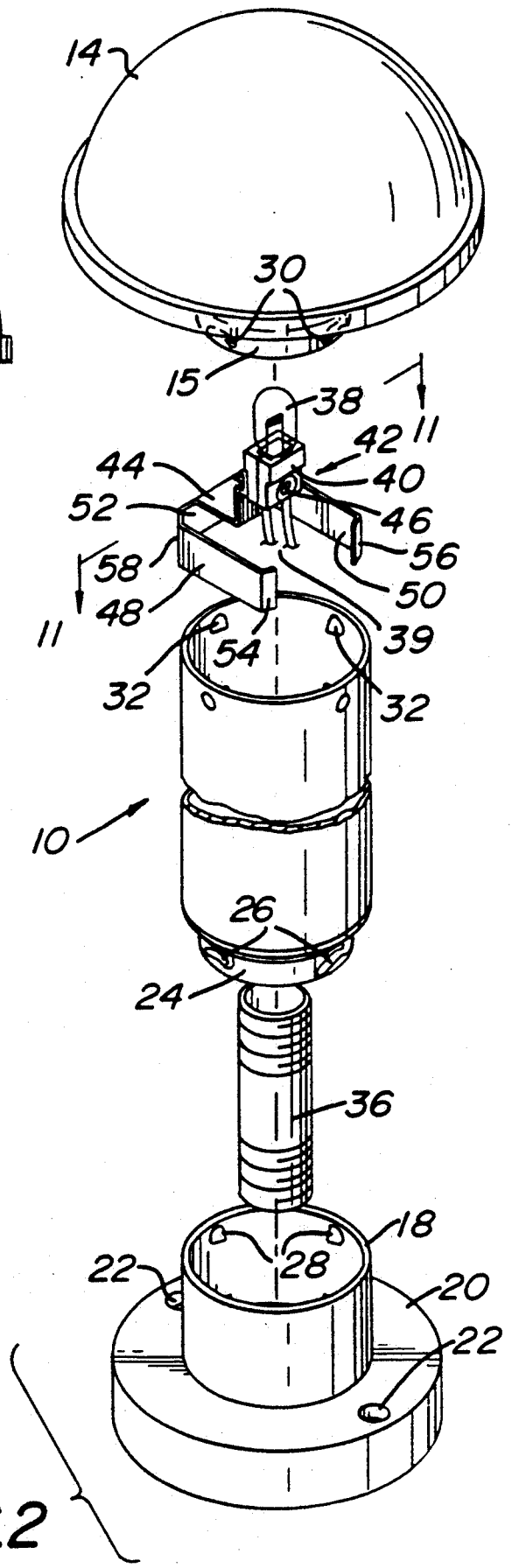
FIG.2

FIG.3
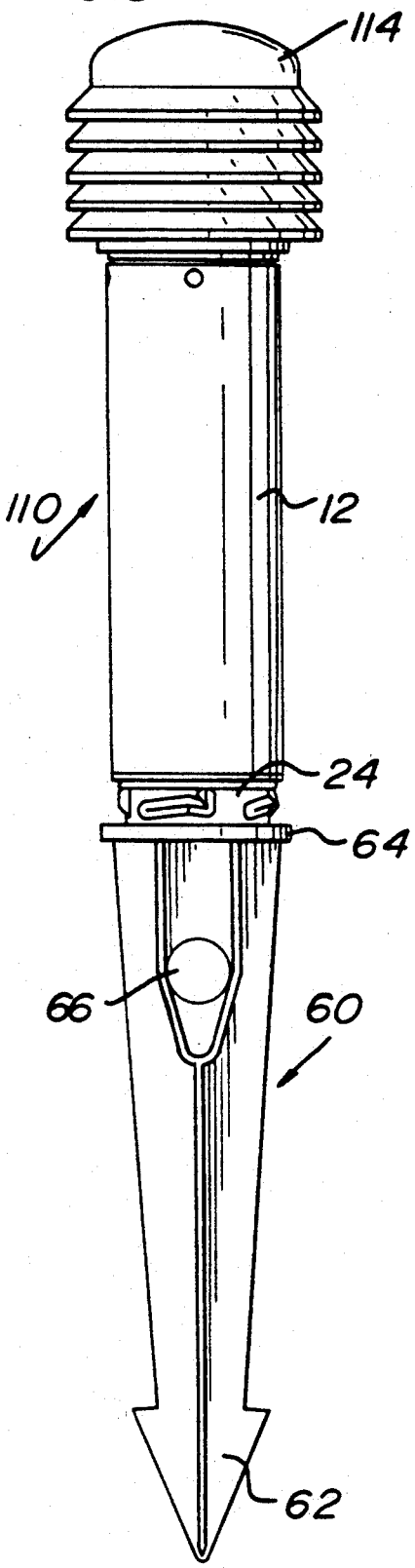
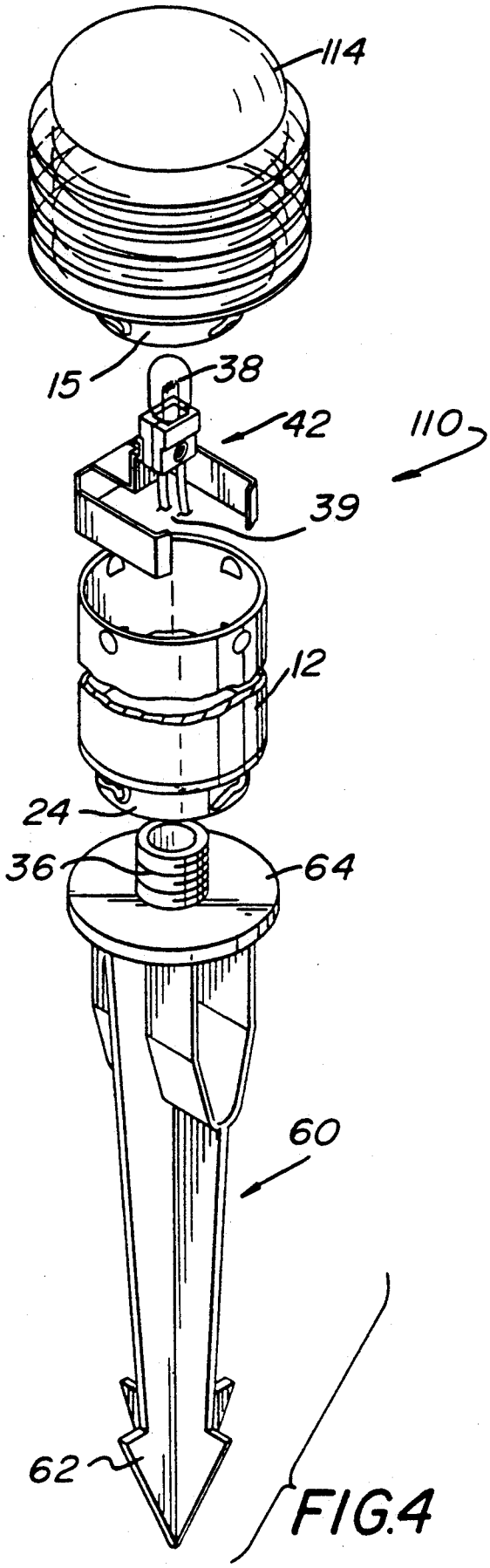
FIG.4

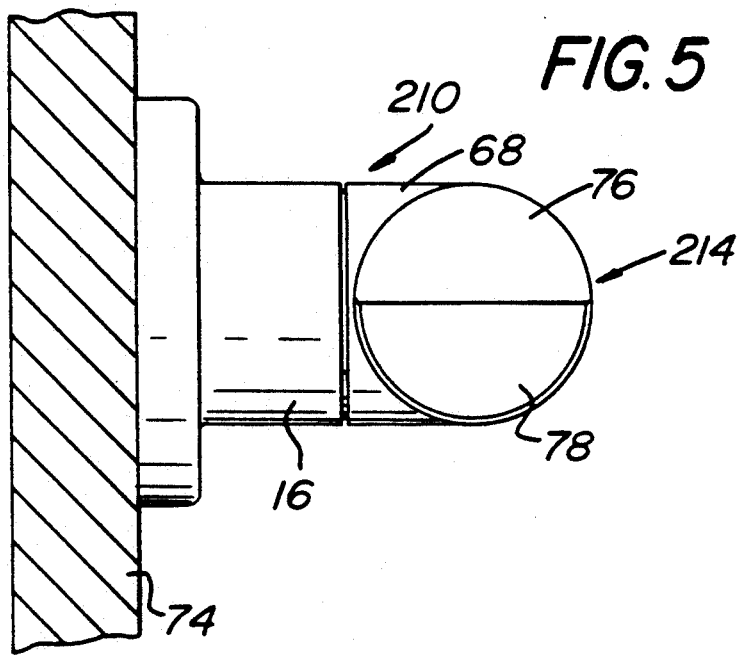
FIG. 5
FIG. 6
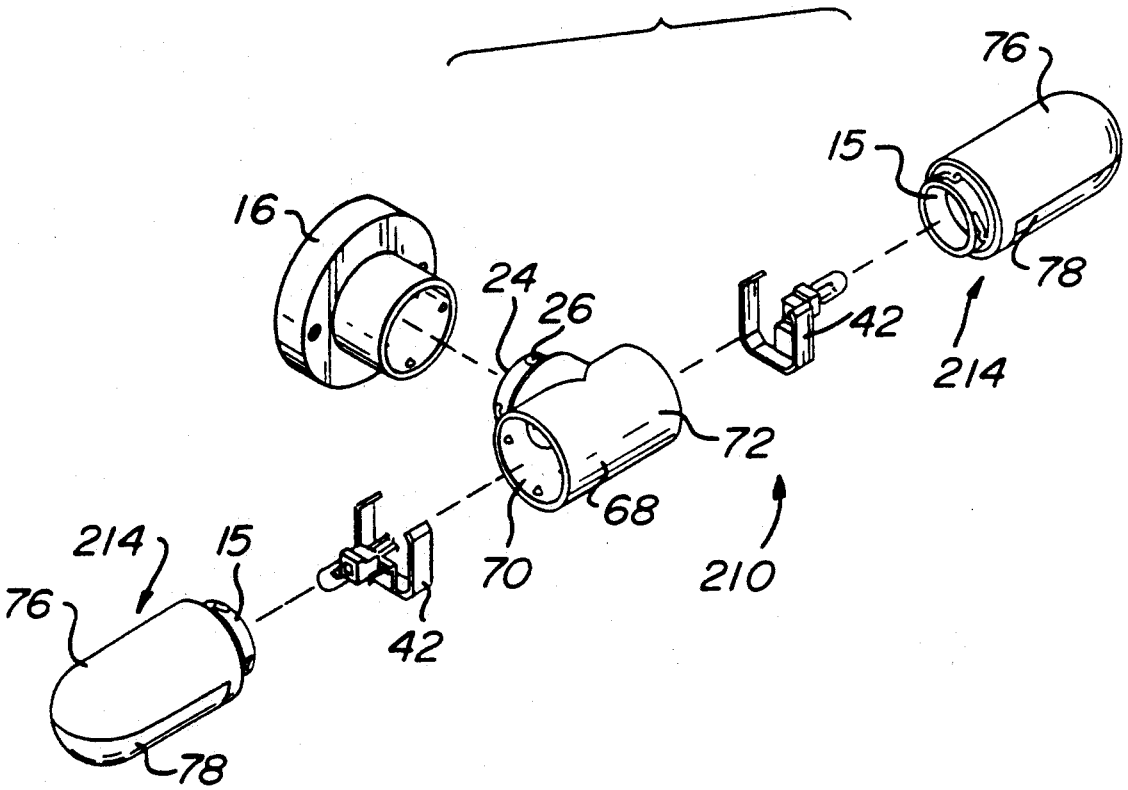

CONFIGURABLE LIGHTING SYSTEM

FIELD OF THE INVENTION

The present invention relates to an easily-configurable lighting system which enables a user to select and assemble various components to create any desired form Of lighting fixture and any desired lighting effect. The invention finds particular utility in landscape and accent lighting, but is useful anywhere a customized lighting effect is desired.

BACKGROUND OF THE INVENTION

It has long been recognized that lighting is an art as well as a science. Illumination from daylight or electric lights enables one to see anywhere, at any time. However, lighting is not merely utilitarian; it is also an art. Lighting as an art has always been an integral part of the theater or the photographer's set, for example.

Modern lighting design goes far beyond these narrow applications, however. Modern lighting design is broadly concerned with not only providing light for the visual tasks to be performed, but also with creating a balanced, comfortable and aesthetically appealing environment, coordinated with the decorative and architectural scheme of the space which the lighting is a part. Today, lighting as an art has brought a more subtle enhancement to the illumination of homes, restaurants, lobbies,. offices, museums, arenas, gardens, terminals, vehicles and, in fact, every kind of space used by people.

To meet the demands of lighting as an art, there is a need for lighting fixtures which give the lighting designer the necessary flexibility and range of aesthetic choice to achieve his design. At the same time, economic considerations dictate that the lighting fixtures be simple and easy to realize in practice.

The present invention meets the needs of the lighting designer by offering unrestrained design flexibility, while simultaneously meeting the practical and economic constraints of any design project. The present invention offers an easily-configurable lighting fixture that uses a small number of components, which keeps inventory and costs down, but enables that small number of components to be interconnected and configured in shapes, styles and combinations that are virtually unlimited.

SUMMARY OF THE INVENTION

The present invention is a selectably-configurable lighting fixture comprising a body having coupling means thereon for selectably and releasably receiving at least one of a plurality of interchangeable components. The components include at least a shade and a mounting member for mounting the fixture to a support. The fixture also comprises a lamp support for supporting a lamp on the body in operative relation to the shade for illuminating a space adjacent the fixture.

The lighting fixture of the present invention can be configured in almost unlimited shapes and combinations by interchanging components as desired.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a side elevational view, partially in section, of one form of lighting fixture according to the present invention.

FIG. 2 is an exploded view of the lighting fixture of FIG. 1.

FIG. 3 is a side elevational view of a second form of lighting fixture according to the invention.

FIG. 4 is an exploded view of the lighting fixture of FIG. 3.

FIG. 5 is a side elevational view of a third form of lighting fixture according to the invention.

FIG. 6 is an exploded view of the lighting fixture of FIG. 5.

DESCRIPTION OF THE INVENTION

Figure 7:
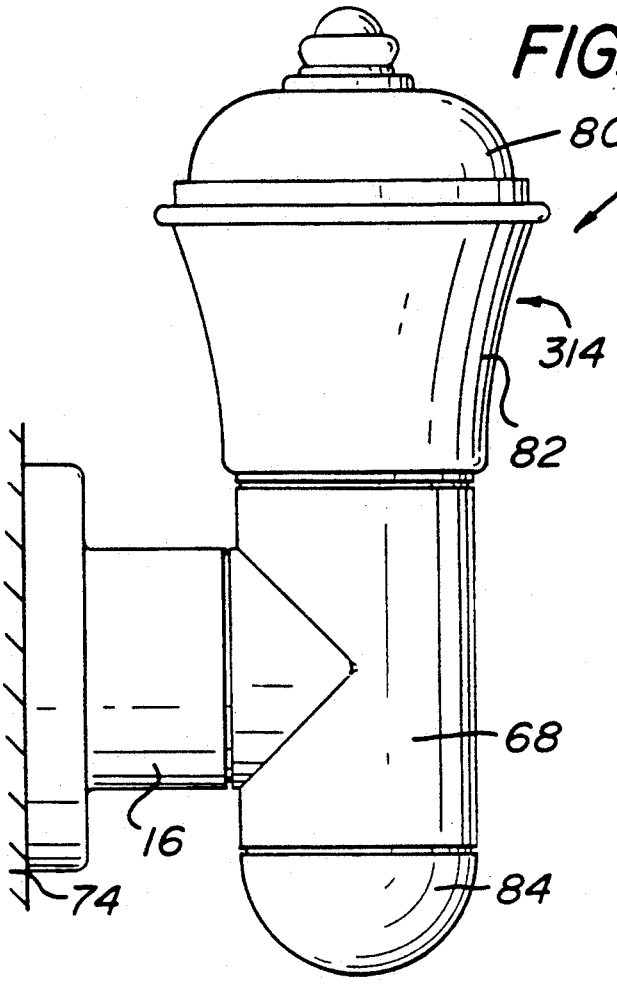
FIG. 7 is a side elevational view of a fourth form of lighting fixture according to the invention.

Referring now to the drawings, wherein like numerals indicate like elements, there is shown in FIGS. 1 and 2 one form of lighting fixture 10 according to the present invention. In the embodiment shown in FIGS. 1 and 2, fixture 10 comprises a body 12, a shade 14 and a mounting means in the form of a flanged base 16. The mounting means may also be in the form of a conduit or stake, as will be described in more detail below. Preferably, but not necessarily, body 12 is in the form of a hollow right cylinder open at each end. Although a right cylinder is preferred and simplifies manufacturing and assembly of completed fixtures, it is not necessary that body 12 be a cylinder, and other shapes and forms of body 12 may be used without departing from the scope of the invention.

Base 16 has a cylindrical socket portion is surrounded by a flange 20. Flange 20 may be formed integrally with socket portion 18, or may be a separate piece and attached to socket portion 18 by any suitable means. Flange 20 is illustrated as generally circular, but may have other shapes as well, and need not even be a continuous piece surrounding socket portion 18 but may comprise tabs or the like. Flange 20 is preferably provided with a plurality of openings 22 through which fasteners, such as nails or screws, may be passed to secure the flange 20 to a support such as a wall, a deck, a ceiling, a post, a railing and the like.

Body 12 is provided at one end with a reduced diameter portion 24 to enable body 12 to be received in socket portion 18 on base 16. Reduced diameter portion 24 may be a separate piece attached to body 12, as shown in FIG. 1, or may be formed integrally with body 12.

Preferably, the outer diameter of reduced portion 24 is about the same as the inner diameter of socket portion 18, so that there is i snug fit between them while at the same time providing necessary clearances for insertion and removal of reduced diameter portion 24 from socket portion 18. Preferably, but not necessarily, reduced diameter portion 24 and socket portion 18 are provided with a twist-lock coupling means, for example, a bayonet-style coupling, to enable reduced diameter portion 24 and socket portion 18 to be securely but releasably attached together. Thus, reduced diameter portion 24 may be provided with a plurality of ramps 26 on its outer surface which cooperate with aligning bosses 28 on the inner surface of socket portion 18. Together, ramps 26 and bosses 28 define a bayonet coupling. As those skilled in the art will appreciate, body 12 may be assembled to base 16 by simply inserting reduced diameter portion 24 into socket portion 18 and twisting. Body 12 may be just as simply disassembled from base 16 by twisting and removing it from socket portion 18.

Shade 14, which may have any desired shape or configuration, is releasably attached to the end of body 12 opposite the end at which reduced diameter portion 24 is provided. Shade 14 is preferably provided with a reduced diameter portion 15, which has an outer diameter about equal to the inner diameter of body 12, so that reduced diameter portion 15 can be inserted therein for a snug fit. Reduced diameter portion 15 is preferably hollow to allow a lamp, which will be described in greater detail below, to extend from body 12 into the interior of shade 14, whereby light from the lamp passes through the shade to illuminate a space around the fixture 10. As with base 16, shade 14 may be releasably attached to body 12 by a bayonet coupling comprising ramps 30 on shade 14 and aligning bosses 32 on body 12.

As will be seen hereinafter, shade 14 may have any desired shape without departing from the present invention. Thus, a mushroom-shaped shade 14 is illustrated in FIGS. 1 and 2, but other forms of shade may be used without departing from the invention, and other forms will be illustrated in later figures.

Preferably, the outer diameter of socket portion 18 is about the same as the outer diameter of body 12, so that, when body 12 is assembled to bass 16, there is a smooth, generally uninterrupted line from flange 20 through body 12. However, if desired, body 12 and socket portion 18 may have different outer diameters to yield a different aesthetic effect.

For convenience in wiring the light fixture 10, reduced diameter portion 24 may be provided with a tapped axial bore 34 for threadedly receiving a correspondingly threaded end of a pipe nipple 36. Pipe nipple 36 provides a convenient passageway for electrical wires when wiring and installing fixture 10 to line voltage. If desired, pipe nipple 36 may be omitted when wiring and installing fixture 10 to low-voltage systems, such as 12 V systems.

Fixture 10 includes a lamp 38 and, as desired, a lamp socket 40 in which lamp 38 is removably inserted. Lamp socket 40 may be any conventional socket for receiving the type of lamp to be used. For example, FIG. 2 illustrates a socket for a bi-pin base halogen lamp, but any suitable socket, such as one for conventional wedge-base bulbs, screw-base incandescent bulbs, or one for compact fluorescent lamps, may be used without departing from the invention.. Lamp socket 40 is supplied with electricity by a pair of wires 39.

FIGS. 3 and 4 illustrate a different form of light fixture according to the invention. In these figures, the same reference numerals are used for the same parts, although some of the reference numbers are omitted for the sake of clarity of the drawings. In FIGS. 3 and 4, the fixture, designated 110, has a shade 114 in the form of a tiered bollard. As with shade 14, shade 114 has a reduced diameter portion 15 with a bayonet-style coupling for releasably assembling shade 114 to body 12. Fixture 110 is also shown with a stake mounting means 60, which enables fixture 110 to be placed in the ground for landscape and walkway lighting and the like. As shown, stake 60 has a pointed, barbed first end 62 which is inserted into the ground and a platform 64 at the opposite end. Platform 64 may be provided with a tapped bore for receiving one threaded end of pipe nipple 36 therein. The opposite threaded end of nipple 36 is received in tapped bore 34 (not shown in FIGS. 3 and 4) in body 12, so that body 12 may be releasably assembled to stake 60. As an alternative, stake 60 may be provided with a threaded member integral therewith which can be screwed directly into tapped bore 34. Stake 60 may also be provided with an opening 66, as may be required, to provide a passageway for wires to enter and exit fixture 110, so that the fixture may be connected to in-ground cable line or low-voltage wiring.

A further form of fixture according to the invention is illustrated in FIGS. 5 and 6. In these figures, the fixture, designated by reference numeral 210, comprises a body in the form of a hollow tee 68 having cylindrical arms 70 and 72. Fixture 210 is shown with a flanged base 16, and is illustrated in FIG. 5 as mounted to a vertical surface such as a wall 74. However, fixture 210 may be mounted to any other suitable support. Tee 68 has a reduced diameter portion 24 with suitable ramps 26 to enable tee 68 to be releasably assembled to base 16, as described above in connection with fixture 10. The open end of each arm 70 and 72 of tee 68 receives a lamp support means 42, as will be described hereinafter in connection with fixture 10.

Fixture 210 is fitted with so-called Euro-style shades 214, which comprise a shroud portion and a lens 78 from which light is emitted. Shades 214 are provided with reduced diameter portions 15 with a suitable bayonet-style coupling so that shades 214 can be assembled to arms 70 and 72 of tee 68. A feature of this form of fixture is that the bayonet-style coupling enables shade 214 to be placed at any one of four angles with respect to tee 68. For example, lamp 214 can be oriented so that shroud 76 is uppermost, as shown in FIG. 5, for a down-lighting effect, or shade 214 may be orientated so that shroud 76 is at the bottom, for uplighting. Shade 214 may also be orientated with shroud 76 facing wall 74 for a direct, outward lighting effect, or orientated with shroud 76 facing outward for an indirect, reflective lighting effect.

Figure 8:
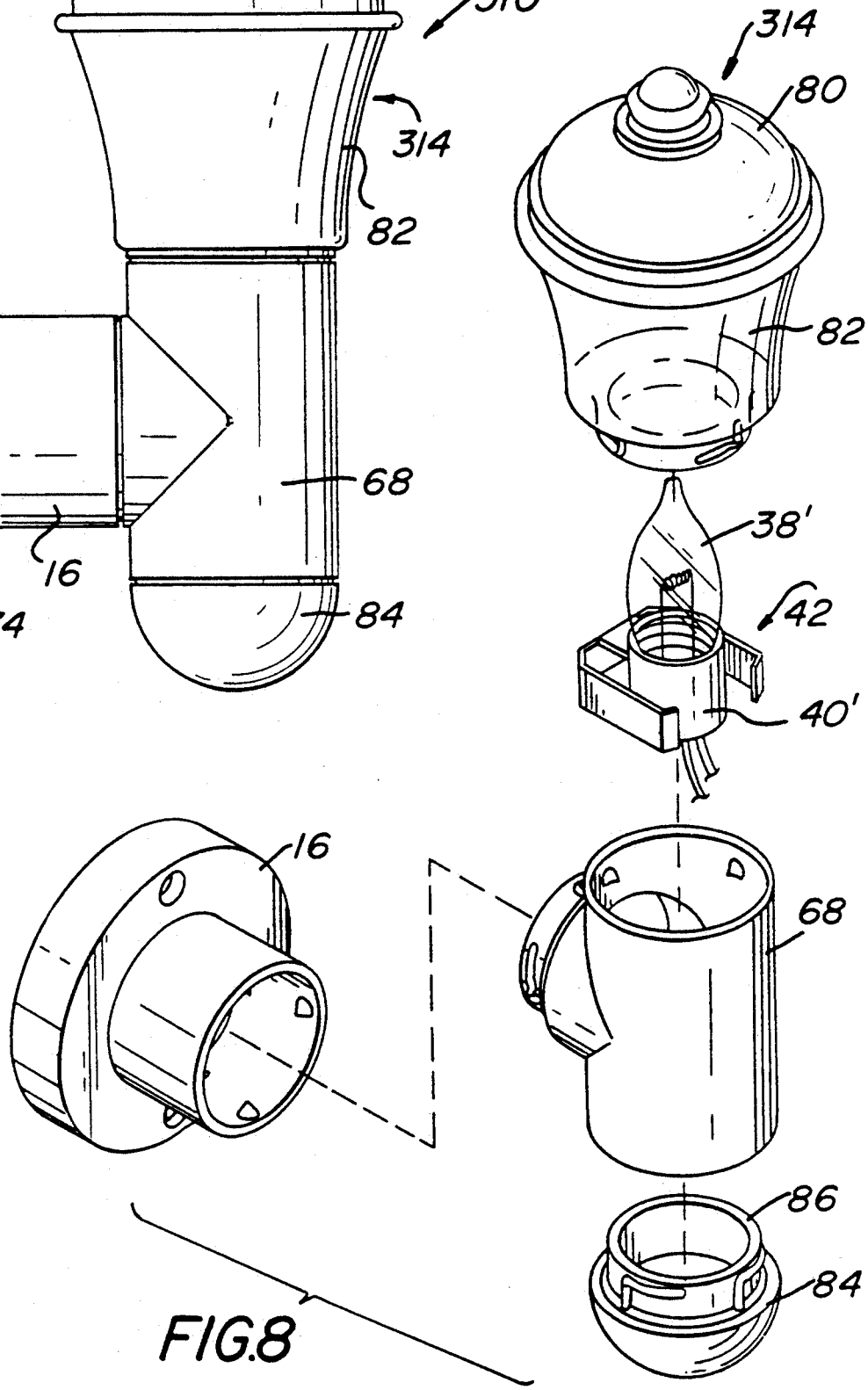
FIG. 8 is an exploded view of the lighting fixture of FIG. 7.

A still further fixture according to the invention is shown in FIGS. 7 and 8. This fixture, designated by reference numeral 310, has a body on the form of tee 68, and is fitted with a lantern-style shade 314. Shade 314 has an opaque roof 80 and a translucent or transparent bowl 82, and is provided with a reduced diameter portion 15 on bowl 82 so that shade 314 can be assembled to one arm of tee 68 in the same manner as the shades described above, Fixture 310 includes a lamp 38', a lamp socket 40' and a lamp support means 42, similar to the other fixtures already described. In this particular embodiment, lamp 38' is a candelabra-style incandescent bulb, and lamp socket 40' is a candelabra socket. As already noted, any suitable bulb and socket may be used without departing from the invention. Fixture 310 also is fitted with an opaque end cap 84 in the other arm of tee 68. Cap 84 has a reduced diameter portion which is essentially identical to reduced diameter portion 15 already described and which allows cap 84 to be releasably assembled to fixture 310.

Figure 9:
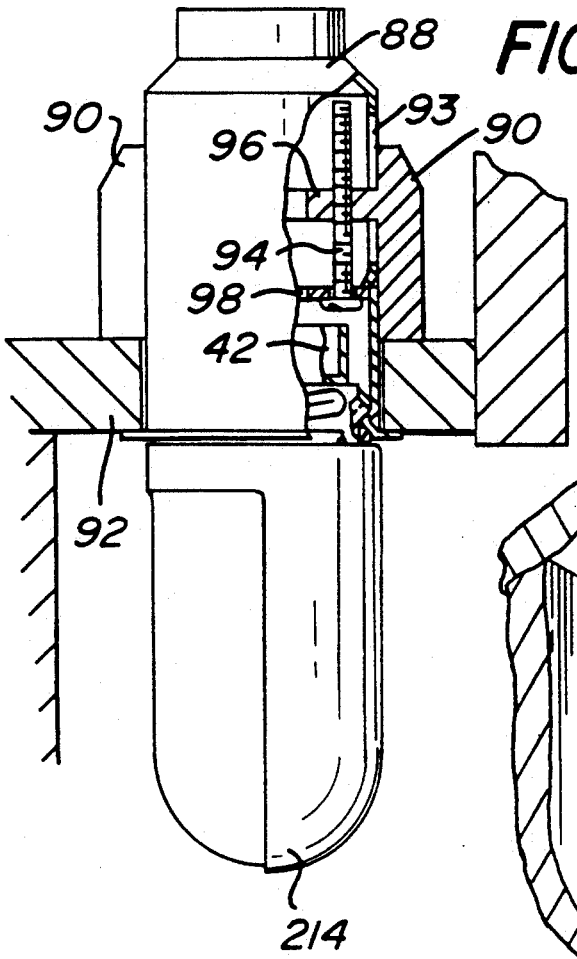
FIG. 9 is a side view, partially in section, of a fifth form of lighting fixture according to the invention.
Figure 10:
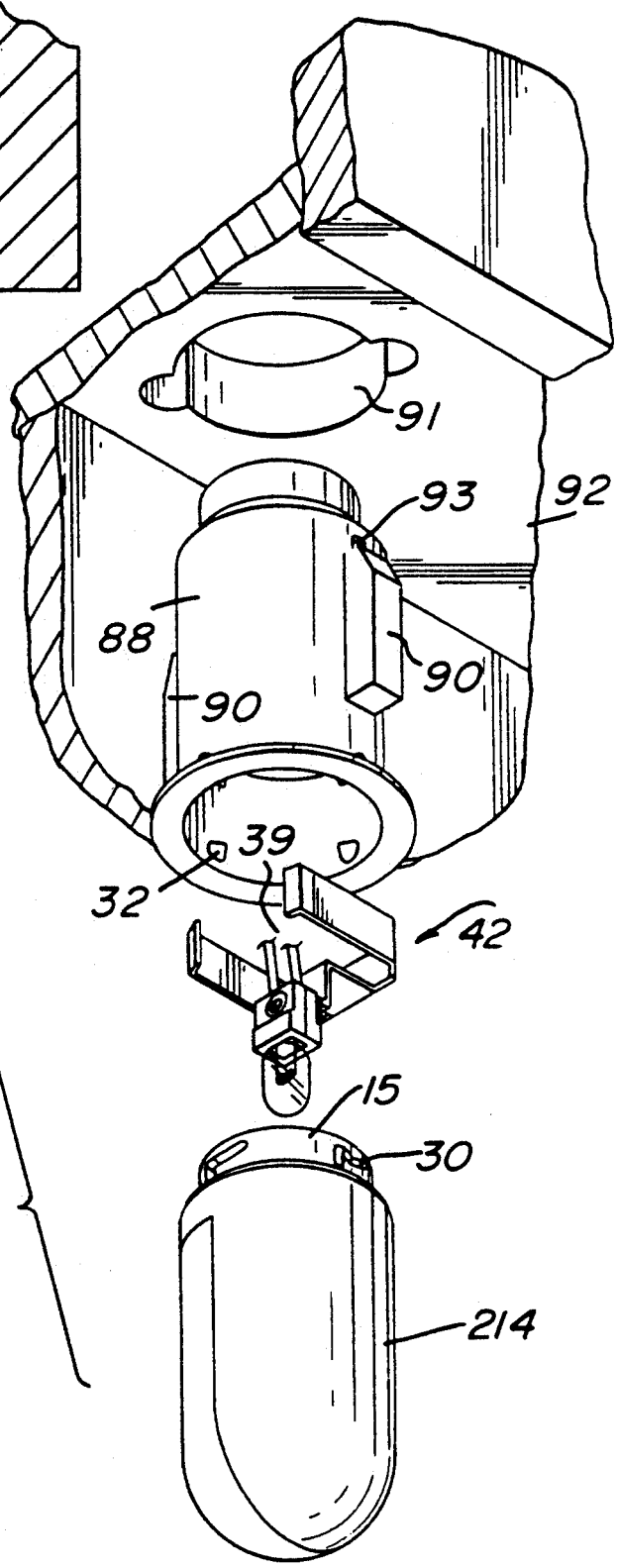
FIG. 10 is an exploded view of the lighting fixture of FIG. 9.

FIGS. 9 and 10 show a fifth form of lighting fixture according to the invention, for installation in a ceiling or soffit. In the lighting fixture shown in these figures, the body is in the form of a recessed housing 88 with diametrically opposed clips 90 to secure housing 88 in recessed relation behind sheet materials such as soffit 92 and similar materials such as walls, decks, fences, railings and the like. As with the other forms of lighting fixtures according to the invention, housing 88 is provided with a plurality of bosses 32 on the interior surface of housing 88 for forming a bayonet-style coupling with a shade, such as Euro-style shade 214 illustrated in FIGS. 9 and 10. In addition, housing 88 receives a lamp support means 42 in one end, in the same manner as will be described hereinafter. The other end of housing 88 is provided with an opening to facilitate the passage of wires 39.

Housing 88 may be easily installed in soffit 92 or other sheet material by making an appropriately-sized hole 91 in the soffit and inserting housing 88 into it. Housing 88 may be secured to soffit 88 by adjusting clips 90 to grip the interior surface of the soffit. For this purpose, housing 88 is provided with a pair of diametrically-opposed axial slots 93 in which clips 90 are free to move in the axial direction. The position of each clip 90 can be adjusted by turning screw 94, which is threadedly coupled to a tab 96 on clip 90. The head of screw 94 is constrained by plate 98, so that turning screw 94 will advance or retract the clip 90 with which it is associated. By turning the screws 94 to advance the clips 90, housing 88 can be firmly secured to soffit 92.

Figure 11:
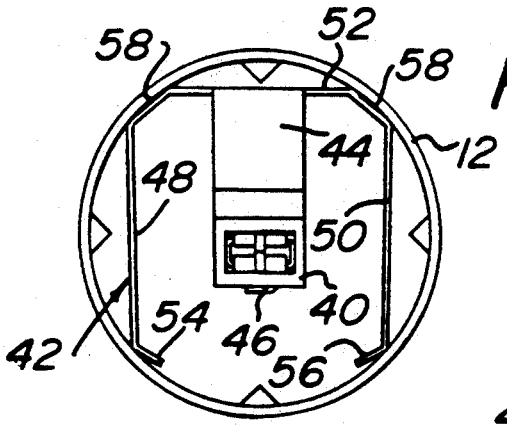
FIG. 11 is an axial view taken along the lines 11—11 in FIG. 2.
Figure 12:
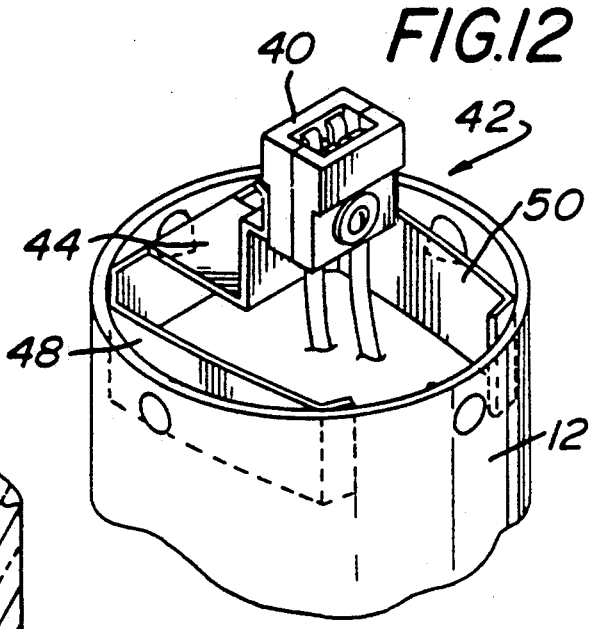
FIG. 12 is an isometric view showing the placement of the lamp support means in the body means, in accordance with the present invention.
Figure 13:
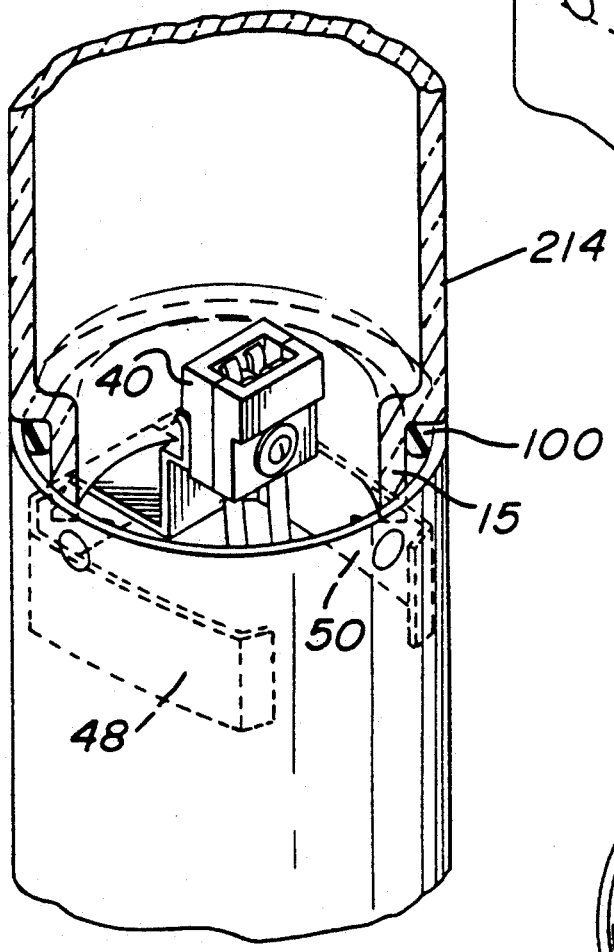
FIG. 13 is a perspective view, partially in section, showing seating of the lamp support means after assembly of a shade means onto a body means, in accordance with the invention.

Regardless of its form, lamp socket 40 is supported inside hollow body 12 by a resilient support means 42, as best seen in FIGS. 11 through 13. Support means 42 comprises a platform means 44 to which is attached of lamp socket 40, such as by a screw 46 or by any other suitable fastener such as a rivet or the like. Support means 42 further comprises a pair of arms 48 and 50, interconnected by a cross-member 52. Arms 48 and 50 have angled ends 54 and 56 at first respective ends thereof, and angled corners 58 at the ends of arms 48 and 50 which join cross-member 52. Arms 48 and 50 and crossmember 52 define chords of a circle corresponding to the interior circular opening of body 12. Arms 48 and 50 are resilient such that they are slightly compressed or bent toward each other when support means 42 is inserted into body 12. Thus, when support means 42 is inserted into the opening in body 12, it is held in place by contact between angled ends 54 and 56 and the angled corners 58, and the interior surface of body 12.

A unique feature of the invention is that the support means 42 is displaceable axially within body 12, since support means 42 is held in place by contact between support means 42 and body 12 and is not rigidly attached to body 12. This feature enables support means to be automatically seated at the proper distance within body 12 so that lamp 38 will extend beyond the end of body 12 and into the interior of the shade used, in this case a Euro-style shade 214. This is easily accomplished by simply inserting support means 42 into body 12, at the end to which shade 214 will be attached, for a short distance sufficient to hold support means in body 12, as shown in FIG. 12. Thereafter, reduced diameter portion 15 of shade 214 is inserted into body 12 at the same end as support means 42. As reduced diameter portion 15 is inserted into body 12, it contacts an abutment means in the form of the upper surfaces of arms 48 and 50 on support means 42 and, as reduced diameter portion 15 is progressively inserted into body 12, it progressively forces support means 42 further into body 12, until reduced diameter portion 15 is fully inserted and shade 214 is seated on body 12, as seen in FIG. 13. This feature of the invention makes it very simple to properly insert support means 42 in body 12, and speeds up assembly time of fixture 10, since it does not require that support means 42 be precisely located before assembling lamp 14 to body 12. All that needs to be done is to insert support means 42 par-dally into body 12 and attach shade 14, and support means 42 is automatically seated at the required location. Once support means 42 is properly seated in body 12, it will remain in place but can be easily withdrawn to change lamps when required and then reinserted as described above. Moreover, if it is desired to reduce the amount of illumination provided by a fixture, the light level can be easily adjusted by simply manually inserting support means 42 further into body 12, as far as may be desired. Still further, support means 42 is removable at any time so that, if desired, a support means with a different socket and bulb style can be installed.

Figure 14:
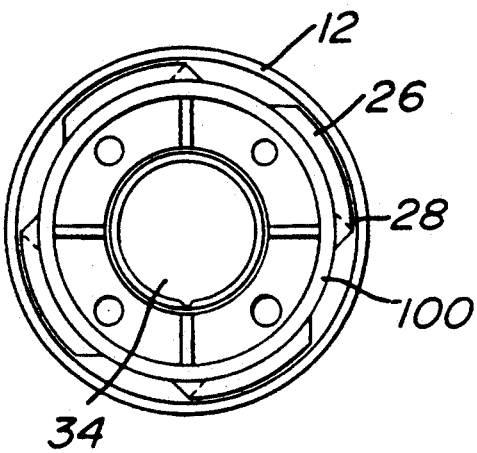
FIG. 14 is an axial view of the reduced diameter end of a body means according to the present invention.

If desired, suitable sealing gaskets such as O-ring 100 may be provided around reduced diameter portions 15 on the various forms of shade, for example as shown in FIG. 13, and around reduced diameter portion 24 on body 12, as shown in FIG. 14. Such sealing gaskets help keep out dust, moisture, insects and other undesired materials, and provide compression to securely hold the parts together.

Although different configurations of the lighting fixture of the present invention have been illustrated and described, it will be appreciated that all of those configurations comprise the features of the invention. That is, each embodiment comprises a body means for selectably and releasably receiving at least one of a plurality of interchangeable components, including at least a shade and a mounting means for mounting said fixture to a support, and a lamp support means for supporting a lamp on said body in operative relation to the shade means for illuminating a space adjacent said fixture.

It will also be appreciated that any shade configuration may be assembled to any body configuration, as may any base configuration. Thus, for example, one may assemble a fixture having a lantern-style shade on a cylindrical body attached to a stake, or one may assemble a bollard shade and an end cap on a tee body with a flanged base for mounting on a vertical surface such as a post or railing. The possible combinations of shade, body and base style are limited only by the imagination of the designer.

The present invention may be embodied in other specific forms without departing from the spirit or essential attributes thereof and, accordingly, reference should be made to the appended claims, rather than to the foregoing specification, as indicating the scope of the invention.

I claim:

1. In a lighting fixture comprising a body having at least a hollow portion adapted to receive a shade releasably attached thereto, lamp support means for supporting a lamp in said hollow portion in operative relation to said shade for illuminating a space adjacent said fixture, said lamp support means comprising a lamp socket for receiving a lamp, resilient engagement means for frictionally engaging an interior surface of said hollow portion for supporting said lamp in operative relation to said shade while permitting at least some movement relative to said hollow portion, and abutment means for contacting a portion of said shade when said shade is attached to said hollow portion such that contact between said shade and said abutment means during attachment of said shade results in positioning said lamp support means at a predetermined position relative to said hollow portion and said shade.

2. A selectably-configurable lighting fixture comprising body means having coupling means thereon for selectably and releasably receiving a plurality of interchangeable components, said components including at least a shade and a mounting means for mounting said fixture to a support, and lamp support means for supporting a lamp on said body in operative relative to the shade, the lamp illuminating a space adjacent said fixture, said lamp support means comprising a lamp socket for receiving a lamp, resilient engagement means for fictionally engaging an interior surface of said body means for supporting said lamp in operative relation to said shade while permitting at least some movement relative to said body means, and abutment means for contacting a portion of said shade when said shade is attached to said body means such that contact between said shade and said abutment means during attachment of said shade results in positioning said lamp support means at a predetermined position relative to said body means and said shade.

3. A lighting fixture according to claim 2, wherein the coupling means comprises a twist-lock coupling.

4. A lighting fixture according to claim 3, wherein the twist-lock coupling comprises a bayonet coupling.

5. A lighting fixture according to claim 2, wherein the body means is in the form of a hollow cylinder.

6. A lighting fixture according to claim 2, wherein the body means is in the form of a hollow tee fitting.

7. A lighting fixture according to claim 2, wherein the body is in the form of a cylindrical housing adapted for recessed installation behind a generally flat surface.

8. A light fixture according to claim 7, further comprising a cylindrical lip on said cylindrical housing, and wherein the mounting means comprises clip means on said cylindrical housing, the cylindrical lip and clip means cooperating to secure said housing to said surface.

9. A lighting fixture according to claim 8, wherein the clip means are adjustable.

10. A lighting fixture according to claim 2, wherein said shade comprises a mushroom-shaped shade.

11. A lighting fixture according to claim 2, wherein the shade comprises a tiered-bollard style shade.

12. A lighting fixture according to claim 2, wherein the shade comprises a lantern-style shade.

13. A lighting fixture according to claim 2, wherein the shade is in the form of a generally closed cylinder, approximately half of said cylinder being at least partially light transmissive and the remainder of said cylinder being opaque.

14. A lighting fixture according to claim 2, wherein said mounting means comprises a base having a flange.

15. A lighting fixture according to claim 14, wherein said flange is provided with a plurality of openings for receiving fasteners therethrough for mounting said base to said support.

16. A lighting fixture according to claim 14, wherein said base includes anchoring means for anchoring said base in the ground.

17. A lighting fixture according to claim 16, wherein the anchoring means is a stake.

18. A lighting fixture according to claim 2, wherein said components further include a cap means.

19. A lighting fixture according to claim 17, wherein, the cap means is generally hemispherical.

20. A selectably-configurable lighting fixture according to claim 2 wherein said resilient engagement means comprises first and second resilient arms that are interconnected by a cross-number.

21. A method for assembling a lighting fixture comprising a body having at least a hollow portion adapted to receive a shade releasably attached thereto and having a reduced diameter portion, lamp support means for supporting a lamp in said hollow portion in operative relation to said shade for illuminating a space adjacent said fixture, said lamp support means comprising a lamp socket for receiving a lamp, resilient engagement means for frictionally engaging an interior surface of said hollow portion for supporting said lamp in operative relation to said shade while permitting at least some movement relative to said hollow portion, and abutment means for contacting a portion of said shade, the method including the steps of:

(a) inserting the lamp support means into one end of the interior surface of the body's hollow portion, the resilient engagement means of the lamp support means frictionally engaging the interior surface of the hollow portion portion after insertion;

(b) placing one end of the shade's reduced diameter portion into the same end of the hollow portion in which the lamp support means was placed so that the shade's reduced diameter portion contacts the abutment means;

(c) progressively inserting the one end of the shade into the body's hollow portions, the one end of the shade simultaneously pushing the abutment means, and thereby the lamp support means, further into the hollow portion until the shade's reduced diameter portion is fully inserted therein.

* * * * *